United States Patent [19]

Ito et al.

[11] 3,966,454

[45] June 29, 1976

[54] METHOD FOR PRODUCING IRON OR IRON ALLOY POWDERS HAVING A LOW OXYGEN CONTENT

[75] Inventors: Shunji Ito; Yasuaki Morioka; Yoshihiro Kajinaga; Minoru Nitta, all of Chiba; Ichio Sakurada, Ichihara, all of Japan

[73] Assignee: Kawasaki Steel Corporation, Kobe, Japan

[22] Filed: June 23, 1975

[21] Appl. No.: 589,564

[30] Foreign Application Priority Data

June 24, 1974 Japan ..... 49-71250

[52] U.S. Cl. ..... 75/.5 BA

[51] Int. Cl.[2] ..... B22F 9/00

[58] Field of Search ..... 75/.5 BA

[56] References Cited

UNITED STATES PATENTS

| | | | |
|---|---|---|---|
| 2,759,808 | 8/1956 | Kuzmick et al. | 75/.5 BA |
| 3,073,695 | 1/1963 | Silbereisen et al. | 75/.5 BA |
| 3,368,890 | 2/1968 | Schroeder et al. | 75/.5 BA |
| 3,418,104 | 12/1968 | Hatcher | 75/.5 BA |
| 3,419,383 | 12/1968 | Hatcher et al. | 75/.5 BA |

*Primary Examiner*—W. Stallard

[57] ABSTRACT

Iron or iron alloy powders having a low oxygen content to be used for powder metallurgy are produced by subjecting iron or iron alloy powder materials having an oxygen content of not more than 8% by weight and a total carbon amount including carbon alloyed in said powders being not more than 6% by weight corresponding to the oxygen content to an induction heating under a relative density of 5–65% based on a density of the molding steel of said powders by means of an alternating current of 50 cycles-1 megacycle to heat said powders at a temperature of 750°–1,400°C to effect reduction rapidly.

11 Claims, No Drawings

METHOD FOR PRODUCING IRON OR IRON ALLOY POWDERS HAVING A LOW OXYGEN CONTENT

The present invention relates to a method for producing iron or iron alloy powders having a low oxygen content to be used for powder metallurgy, which is feasible to decrease the residual oxygen in the powders far more rapidly than the conventional process by introducing an induction heating process into the final reduction step.

The recent powder metallurgy technic is broading the use field from the production of small size of machine parts to the production of machine parts or tools having a high toughness or a large size of machine parts or materials (for example, plates obtained by powder rolling) by increasing the densification and the strength and various studies have been made for obtaining the high strength products.

In this case, one of the most important factors is the oxygen content in the powders.

For example, in the iron or iron alloy powders, 1,000–5,000 P.P.M. of oxygen is usually contained even in the pure iron powders and when machine parts having a high density are manufactured by using such powders as the starting material, it has been well known that the fatigue strength and toughness are adversely affected.

In low alloy steel powders or high alloy steel powders, the oxygen content more increases and the powder manufacturers most labor in the means for decreasing oxygen.

In general, the deoxidation of the powders is effected by annealing at a high temperature by means of a reducing gas, such as hydrogen or annealing at a high temperature under vacuum by an outer heating system and in these processes the powders are indirectly heated and a high temperature and a long time are necessary and the sintering between the powders proceeds and the pulverizing ability of the cake after the final reduction becomes worse and the control of dew point of the atmosphere in the furnace is severe and there are many limitations in the temperature in view of the furnace structure, so that it is very difficult to manufacture a large amount of steel powders having a low oxygen content in a low cost.

Thus, it has been proposed that the alloy components which are mainly Ni or Mo, are added to make the deoxidation easy. When cheap Mn and Cr, which are usually alloyed in the molding steel, are previously alloyed in the molten steel and the resulting alloy is formed into powders by a commercially inexpensive process, for example, water atomizing process, these elements are easily oxidized and the proper process for deoxidizing the resulting powders has never been satisfactorily developed.

When it is attempted to effect the final reduction of such powders by a usual process, the reduction temperature becomes high and the condition of the atmosphere becomes severe and said reduction is very difficult and the cost is necessarily increased. Furthermore, the pulverizing ability of the cake after the final reduction is very worse, because the reduction step prolongs and the sintering between the powders proceeds and the pulverized powders are very hard, so that after the pulverizing, the working stress remains on the pulverized powders and the powders themselves harden and hence the compactibility of the formed powders is deteriorated.

The present invention aims at the simple solution of these problems and comprises adjusting the reduction condition of the iron or iron alloy powders produced by various processes by decreasing the oxygen content of the powders prior to the final reduction and decreasing the total carbon content including carbon alloyed in the powders depending upon the oxygen content in the powders and heating said powders by an internal heat generation, whereby the time necessary for the heating is considerably reduced and as the result the reduced cake can be easily pulverized and the iron or iron alloy powders having a low oxygen content and an excellent compactibility can be easily manufactured. In the present invention, an alternating current having a low, middle or high frequency is used for heating the above described iron or iron alloy powders prior to the final reduction by an internal heat generation.

In the present invention, an induction heating process is utilized but is essentially different from the dielectric heating process used in the heating and drying of plastics and woods.

Namely, the objects to be heated by the dielectric heating in plastics or woods are insulating materials or substantially insulating materials and the used frequency is so called high frequency or super high frequency of more than 1 megacycle, while in the induction heating process of the present invention the objects to be heated are semiconductors or conductors, so that the upper limit of the used frequency is 1 megacycle and in general, the frequency less than such a limit is used.

Such an induction heating process has been broadly applied to melt refining and heat treatment of block metals and even in the powder metallurgy, the induction heating process has been applied to the products having an apparent density of more than 70%. such as a green product and a sintered body, while the induction heating process has never been applied to heating of powders wherein individual particles are independent as in the reduction of the iron or iron alloy powders.

In the present invention, a variety of investigations have been made with respect to the iron or iron alloy powders to be finally reduced and it has been found that an alternating current of 50 cycles-1 megacycle is used under the relative density of 5–65% based on the density of the molding steel of the iron or iron alloy powders, whereby a particularly effective induction heating can be attained.

The raising temperature owing to the induction heating results from the internal heat generation and has the following merits.

1. The heating to raise temperature can be effected within a very short time and the powders having a very low oxygen content can be obtained within a very short time.

2. The highest temperature capable of being industrially realized in the usual vacuum furnace and reducing furnace is about 1,150°C in view of the furnace structure and the other limitations, but in the direct induction heating of the powders themselves as in the present invention, the possibly high temperature can be realized within a very short time and since refractories are not directly heated, the durability of the furnace can be prolonged.

3. The time for heating and keeping the temperature is short, so that the sintering between the powders does not too proceed and the pulverizing ability of the cake is very favorable and for example, even when the heating at 1,350°C is kept, the pulverizing can be easily effected.

4. Any of horizontal furnace and shaft furnace can be used.

The intermediate products among the powders for the powder metallurgy include non-finally reduced iron or iron alloy powders produced in the known processes, for example, plate-shaped sponge iron precipitated on a cathode in the electrolysis, preliminarily reduced cake in a reduction process, that is sponge iron or pulverized products thereof, atomized iron or iron alloy powders and stamped powders in a mechanical crushing process and the final products mean ones which are commercially available as the iron or iron alloy powders after the final reduction.

However, heretofore, even the final products are not always the powders having a low oxygen content and in the difficultly reducible powders, there is the powders having a high oxygen content and even in the commercially available pure iron powders, the oxygen content is 1,000–5,000 P.P.M. and is usually higher in one or two orders than that of the molding steel.

The terms "intermediate product" and "final product" used herein include also cake obtained by sintering a powdery material under vacuum or a non-oxidizing atmosphere, such as neutral or reducing atmosphere by a well known process or powders obtained by pulverizing said cake.

The term "iron or iron alloy powders" used herein means the pure iron powders and the iron alloy powders, but when such iron or iron alloy powders are subjected to the induction heating, if the relative density is less than 5% based on the density of the molding steel, the time for raising temperature by the induction heating becomes considerably long, while when the relative density exceeds 65%, the pulverizing ability of cake after the induction heating and deoxidation is very poor and the pulverizing is difficult, so that the lower and upper limits of the density are 5% and 65% respectively.

The iron or iron alloy powder materials include one in which the powders are naturally filled, one in which the powders are compacted and filled under a pressure less than 1 t/cm$^2$ in order to improve the filled state without aiming compaction, or a tap filled one, but the relative density of these materials should be within the above described range.

When the iron or iron alloy powder materials having the oxygen content of 0.6–8.0% by weight are heated by the induction heating process, it is necessary to use a relatively higher frequency than the iron or iron alloy powder materials having a lower oxygen content than the above described materials but in the above described range of the oxygen content, the necessary frequency is 150 cycles to 1 megacycle.

As the oxygen content in said iron or iron alloy powder materials increases within the above described range, the frequency to be used must be generally increased within the above described range. This is presumably because the specific resistance of the iron or iron alloy powder materials also increases, as the oxygen content in the iron or iron alloy powder materials increases.

Although the induction heating and the deoxidation of iron or iron alloy powder materials having an oxygen content exceeding 8.0% by weight are naturally possible, the present invention mainly aims at the final reduction of iron or iron alloy powder materials, which is referred to as the secondary reduction and it is an object that the powders having a low oxygen content are produced and supplied cheaply in a short time and a large amount, so that the upper limit of the oxygen content in the iron or iron alloy powder materials is defined to be 8.0% by weight. That is, when the oxygen content exceeds 8.0% by weight, even if the heating to raise temperature can be conducted in a short time, a relatively long time is needed for the reduction.

After various investigations, it has been found that the powder material having the oxygen content of not less than 0.6% by weight and the powder material having the oxygen content of less than 0.6% by weight relatively deviates in the frequency band which can heat these powder materials to raise temperature and in the powder material of the oxygen content of 0.6–8.0% by weight, the frequency band of 150 cycles to 1 megacycle, preferably 10 kilocycles to 1 megacycle is preferable.

The frequency band when the iron or iron alloy powder materials having the oxygen content of less than 0.6% by weight are subjected to the induction heating, is relatively lower than that to be used for the powder materials having a higher oxygen content and is preferred to be 50 cycles to 500 kilocycles, more particularly 50 cycles to 10 kilocycles.

Namely, the range of the frequency substantially depends upon the oxygen content of the powder materials and in the present invention, the range from 50 cycles to 1 megacycle is preferable in view of the heating efficiency. When the frequency is beyond the range of 50 cycles to 1 megacycle, the heat efficiency lowers.

Oxygen containing in the iron or iron alloy powder materials includes oxide or hydroxide (mainly iron oxide, iron hydroxide) film on the surface of the iron or iron alloy powders, iron oxide or iron hydroxide powders, or agglomerates or sintered bodies thereof mixed on the iron or iron alloy powders and oxides of alloy components, such as Mn, Cr, Mo and the like. Furthermore, in the structure of iron oxide and iron hydroxide, $FeO$, $Fe_3O_4$, $Fe_2O_3$, $Fe(OH)_2$ and $Fe(OH)_3$ are included and complex compounds or mixtures of these compounds with the other metal oxides or hydroxides may be considered.

Moreover, it has been found from the experimental results that in the iron or iron alloy powder materials having the oxygen content of 0.6–8.0% by weight, the main body causing the internal heat generation by the induction current is iron oxide and iron hydroxide contained in the powder materials and in the iron or iron alloy powder materials having the oxygen content of less than 0.6% by weight, the metal iron particles themselves mainly cause the internal heat generation.

Accordingly, the frequency bands preferred for both the above described powder materials relatively deviate as mentioned above.

When the heating according to the present invention is conducted under vacuum or a neutral atmosphere, carbon must be contained (prealloyed and/or premixed) in the iron or iron alloy powder materials as a reducing agent but the structure of carbon to be contained may be any structure, for example, a liquid-formed carbon, such as oils may be mixed, or a solidformed carbon, such as graphite powder may be mixed. Alternatively, in the powders to be produced by the atomizing process, carbon may be previously alloyed in the molten steel prior to the atomizing and then the molten alloy is atomized and said carbon is used as a reducing agent. In any of the mixing process and the alloying process, the total amount of carbon may be more than the amount necessary for the deoxidation of the iron or iron alloy powder materials and not more than 6.0% by weight.

As mentioned above, the main body of the reducing agent in the present invention is carbon contained in the powder materials but when carbon is too much contained in the final product powder, the properties of the powders to be possessed, for example, the compressibility and the compactibility of the formed powders may degrade. In such a case, 2–27% by weight based on the powders of water is previously added and said powders are heat-treated in order to adjust the carbon amount in the final powders.

The added water evaporates at 170°–180°C in a reducing atmosphere but the powders have been moderately oxidized during the evaporation, so that this oxygen reacts with the remaining carbon and the decarburization proceeds and the carbon amount in the final powders can be adjusted in a low amount. In this case, the other effect of the added water is to form bridge between the powders and the filling state of the powders is maintained coarsely, so that the pulverizing ability of the resulting cake is more improved.

Concerning the atmosphere in the heat reduction, in the case of an atmosphere of a reduced pressure, the vacuum degree is to be higher than 1 mmHg, in the case of a neutral atmosphere, said atmosphere mainly consists of inert gases, such as $N_2$, Ar, He and the like, and in the case of a reducing atmosphere, said atmosphere is a reducing gas, such as CO, $H_2$, hydrocarbons and the like, alone or in admixture or mixtures of these gases with inert gases, such as $N_2$, Ar, He and the like and said atmosphere is adjusted to be neutral or reducing atmosphere depending upon the element of the powder component.

The temperature for keeping the heating is 750°–1,400°C. At a temperature of lower than 750°C, the deoxidation needs a long time and it is impossible to obtain the powders having a low oxygen content as aimed in the present invention. While, when the temperature exceeds 1,400°C, even if such a heating is kept for a very short time, the pulverizing ability of the finally reduced cake becomes worse and there is a fear that the reduced product is partially or completely fused.

The time for keeping the above described temperature range may be set optionally depending upon the oxygen content in the powders of the reduced product but in spite of the fact that the keeping time is far shorter than that of the conventional process, the deoxidation can be fully conducted. Namely, after the temperature is raised to the above described temperature range, even if said temperature is immediately fallen, the deoxidation is substantially completed. This is the most remarkable characteristic and merit of the deoxidation through the direct induction heating of the present invention.

Namely, for the deoxidation of the iron or iron alloy powder materials, a directly induced eddy current is flowed through said powder materials to generate heat and the deoxidation is effected under the elevated temperature but in this case, the rate of deoxidation is much more strong than that of the usual deoxidation process of the indirect heating through an outer heating system and the oxygen content can be decreased to a lower level in such a short time, that is referred to as "forced deoxidation". This is presumably due to the fact that the deoxidation mechanism of the present invention is a deoxidation under a non-equilibrium state owing to a rapid heating, which is greatly different from the conventional process.

The heating process according to the present invention includes the following process in order to advance the deoxidation more effectively in addition to the above described process wherein the starting powders are heated from room temperature to the given temperature and the elevated temperature is kept for a given time and then is fallen down.

That is, after the given temperature is kept, the temperature is cooled to an optional temperature lower than $Ar_1$ transformation temperature at which pearlite transformation is formed and then the heating to raise temperature, keeping said temperature and cooling in the same manner as described above are again repeated and when the heating to raise temperature and keeping said temperature are repeated, the heating to raise temperature and keeping the temperature are conducted by the direct induction heating.

Namely, in this repeating process, after a relatively gradual cooling is effected to form the pearlite transformation and a rapid heating is effected to develop the segregation state of carbon at a high temperature, the deoxidation can be effectively performed. The cycle of heating to raised temperature, maintaining the temperature and cooling may be repeated as necessary, but in the iron or iron alloy powder materials, such as austenite and pure iron powder having a very low carbon content, which have no pearlite transformation, this repeating process is not effective.

The following examples are given for the purpose of illustration of this invention and are not intended as limitations thereof.

The following Table 1 shows the chemical composition and the relative density of the iron or iron alloy powder materials to be used in the final reduction;

Table 2 shows the final reduction and conditions of these powder materials;

Table 3 shows the amount of carbon and oxygen in the powder materials prior to the final reduction and the amounts of carbon and oxygen of the finally reduced powders; and Table 4 shows the behavior of carbon and oxygen when the method of the present invention is carried out under vacuum or a neutral atmosphere and when the final reduction is carried out by the conventional process.

In Table 1, the powder material A is the commercially available reduced iron powders in which mill scale is used as the starting material.

The powder material B is produced by preliminarily reducing a by-produced hematite obtained by treating a waste acid from the pickling line in an iron manufacturing factory, with coke and pulverizing the thus formed sponge iron.

The powder material C is one obtained by preliminarily reducing mill scale to a reduction percentage of about 70% and pulverizing the thus reduced cake, in which the average oxygen content is very high.

The powder material D is water atomized pure iron powders.

The powder material E is low alloy steel powders containing 1.3% by weight of Mn, and 0.5% by weight of each Ni, Cr and Mo and obtained by water atomizing said low alloy steel and then reduction annealing the atomized alloy steel powder under hydrogen at 1,000°C for 4 hours, said powder material having a relatively low oxygen content.

The material F is a sintered cake prior to pulverizing obtained by subjecting the powder material I as explained hereinafter to the induction heating at 1,350°C for 15 minutes under vacuum of $10^{-2}$ mmHg to effect deoxidation and the oxygen content is very small.

The powder material G is one obtained by pulverizing this cake F.

The powder material H is one obtained by spraying water on the powder G and drying the wet powder in air and repeating these treatments to again oxidize said powders (partially formed iron hydroxide).

The powder material I is water atomized low alloy steel powder and the above described powder material E is obtained by reducing the powder I under hydrogen.

In the powder materials A, B, C, D and H, graphite powder is afterwards mixed so that the total carbon amount becomes the values as shown in Table 1.

Furthermore, the powder material I is one obtained by alloying about 1% by weight of carbon in the molten steel just before the water atomizing.

On the other hand, the powder material J is one obtained by atomizing the molten steel containing 0.21% by weight of carbon and then mixing 3% by weight of rape seed oil to the atomized powders.

The powder material K is a high alloy steel powder obtained by water atomizing SKH-9 (high speed steel, corresponding to AISI M2) in which the carbon amount in the molten steel is high.

The powder material L is water atomized low alloy steel powders having such an alloy composition that about 0.35% by weight of Si is alloyed in the powder material I.

The variation of the oxygen contents when the above described powder materials A-L are subjected to the final reduction treatments as shown in Table 2, is shown in Table 3.

In Table 2, Examples 1 and 2 are embodiments of the final reduction of the powder material A and A-1 follows to the method of the present invention and A-2 follows to the conventional hydrogen reduction.

In A-1, the powder material A is subjected to the induction heating at 1,300°C for 15 minutes under vacuum of about $10^{-2}$ mmHg by means of a frequency of 8.3 KHz to effect deoxidation. Even in the heating at such a high temperature, the keeping time is short, so that the sintering between the powders do not so much proceed and the deoxidized product can be satisfactorily pulverized.

The oxygen content of the powders obtained in A-1 is 162 P.P.M. as shown in Table 3. On the other hand, in the conventional process of A-2, the oxygen content is 735 P.P.M. and is higher than that in A-1. This is because the reduction temperature in the conventional process is low as 1,000°C. Even though the reduction is effected by using hydrogen having a high purity (dew point (D.P.):−50°C) and a reduction time is 10 hours and a time for raising temperature is 3 hours, the oxygen content does not lower.

The reason why a temperature exceeding 1,000°C is not used in the conventional process is based on the fact that if such a high temperature is used in the pure iron powders, the sintering among powder particles proceeds and the following pulverizing step of the cake becomes more difficult.

As shown in the above described A-1, the powders having a low oxygen content can be manufactured by applying the method of the present invention and this is because the mixed graphite powders act as a deoxidizing agent. In order to confirm this fact, when a material in which graphite powder is excluded from the powder material A, is subjected to the induction heating under vacuum in the same manner as in A-1, the oxygen content in the resulting powders is 0.31% by weight and is substantially the same as in the oxygen content prior to said heating. Thus, in the case of the powder material containing very low carbon, deoxidation does not occur even under the application of present invention.

Examples 3 and 4 show embodiments when the preliminarily reduced powders B are subjected to the final reduction and in B-1, the method of the present invention is applied and in B-2, the conventional hydrogen reduction process is applied. Since the oxygen content of the powder material B is higher than that of the powder material A, in B-1, graphite powders are added and a frequency of 380 KHz is used and the reduction is carried out at 1,150°C for 15 minutes under vacuum of about $10^{-2}$ mmHg. IN B-2, graphite powders are not added and the reduction is carried out under hydrogen atmosphere (D.P. −50°C) at 1,000°C in the conventional heating process but the reduction time is long as 5 hours. The oxygen content in B-1 is 149 P.P.M., while the oxygen content in B-2 is 833 P.P.M. and the oxygen content in the conventional process is higher than that in the method of the present invention.

Examples 5 and 6 are embodiments wherein the powders obtained by pulverizing sponge iron obtained in the course of the preliminary reduction are mixed with graphite powders and the resulting mixed powders are subjected to the final reduction following to the method of the present invention (C-1) and the conventional process (C-2).

In C-1, the deoxidation is effected at 1,300°C for 15 minutes under vacuum of about $10^{-2}$ mmHg by means of a frequency of 380 KHz. In this case, the temperature is raised to 1,000°C by 3 minutes, kept at 1,000°C for 6 minutes to advance the deoxidation and decarburization, and then the temperature is raised to 1,300°C in 1 minute to effect the deoxidation.

In this case, the mixed graphite powders themselves generate heat by the induction heating (an experiment shows that even when only graphite powders are used, the temperature is raised by the induction heating) but a material in which graphite powders are excluded from the powder material C also can be subjected to the induction heating, so that the present invention regards that the iron oxide portion generates essentially heat.

In C-2, the powder material C is reduced at 1,000°C for 10 hours under hydrogen atmosphere (D.P.: −50°C) and the oxygen content in the resulting powders is 1,800 P.P.M. and when said content is compared with 227 P.P.M. in C-1, said content is about 8 times of that in C-1.

Examples 7–9 show embodiments wherein the powder material D (about 0.25% by weight of C is alloyed in the molten steel and said molten steel is atomized and then graphite powders are mixed therewith) are subjected to the final reduction and D-1 and D-2 show the case of the present invention and D-3 shows the case of the conventional process.

In D-1, the reduction is effected under vacuum of about $10^{-2}$ mmHg and in D-2, the reduction is effected under a neutral atmosphere of $N_2$. In both cases, since the oxygen content in the powder material D is high, a frequency of 380 KHz is used and the reduction condition is 1,150°C × 15 minutes. In D-3, the reduction is effected at 1,000°C for 10 hours under hydrogen atmosphere (D.P.: −50°C). Furthermore, in D-1 and D-2, a temperature of 1,000°C is once kept in the course of raising temperature, and then the temperature is raised to 1,150°C.

The oxygen contents in the reduced powders are 189 P.P.M. in D-1, 322 P.P.M. in D-2 and 892 P.P.M. in D-3. It can be seen that the deoxidation in the method of the present invention is remarkably excellent.

Examples 10 and 11 show embodiments wherein the powder materials E (Mn-Ni-Cr-Mo low alloy steel powder having a high content of Mn, obtained by reducing the powder material I by a conventional process) are treated with the method of the present invention (E-1) and the conventional process (E-2). In this cse, the oxygen content in the powder material E has been lowered to a certain degree, so that in E-1, a frequency of 8.3 KHz is used. The reduction condition in E-1 is under vacuum (about $10^{-2}$ mmHg) and 1,350°C × 15 minutes. In E-2, the reduction is effected under hydrogen (D.P.: −50°C) at 1,150°C for 20 hours. The oxygen contents of the obtained powders in E-1 and E-2 are 214 P.P.M. and 537 P.P.M. respectively and it can be seen that the method of the present invention is also excellent for the deoxidation of the low alloy steel powder.

The reason why the reduction temperature of 1,150°C is used in E-2 is based on the limitation resulting from the furnace structure and it is difficult in practice to use the higher temperature than 1,150°C. Even if the reduction can be effected at a temperature higher than 1,150°C, the pulverizing ability of the cake after the final reduction will be more deteriorated, so that the upper temperature limit in the conventional process is 1,150°C for such a low alloy steel powder. (In fact, when the powder material was reduced at 1,200°C for 3 hours under hydrogen atmosphere by means of a small type tubular furnace, it was impossible to pulverize the resulting cake).

Examples 12 and 13 show embodiments relating to the powder material F (sintered body having an apparent density of 3/54 g/cm$^3$), which is a cake having a low oxygen content (oxygen content: 377 P.P.M.) and is obtained by subjecting the low alloy steel powder I to the induction heating at 1,350°C for 15 minutes under vacuum of about $10^{-2}$ mmHg.

In F-1, the reduction is carried out at 1,350°C for 20 minutes under vacuum of $10^{-2}$ mmHg by means of a frequency of 3 KHz. That is, the powder material is subjected to the direct induction heating from room temperature to 1,350°C and once said temperature is kept for 10 minutes and then gradually cooled to 600°C to form pearlite transformation and segregate carbon, whereby the deoxidation is effectively effected and then the temperature is again raised by the induction heating and again kept at 1,350°C for 10 minutes to effect the deoxidation forcedly. In this case, the heating from room temperature to 1,350°C can be effected in only 30 seconds.

F-2 is the case where a frequency of 380 KHz is used and in this case, the frequency is too high for the starting powder and it is difficult to raise the temperature effectively from room temperature by the induction heating process. So, preheating is effected to 600°C by the conventional process and then the preheated sintercake F is heated to 1,350°C by the induction heating process, after which the same heat treatment as in F-1 is adopted. It has been found that a high frequency such as 380 KHz is unsuitable for the induction heating from room temperature, but when the starting powders are preheated to a certain degree, the induction heating can be effectively conducted.

When a high frequency as in 380 KHz is used, about 3 minutes are needed only for raising the temperature from 600° to 1,350°C, while the necessary time in F-1 is only 30 seconds for heating the sintered cake from room temperature to 1,350°C. From this comparison it can be seen that the rate for raising temperature in the case of the high refrequency of 380 KHz is fairly slow.

It has been found that such differences of the rate for raising temperature and frequency affect to the deoxidized amount, so the oxygen content in F-1 is 98 P.P.M., while said content in F-2 is 139 P.P.M., namely the latter oxygen content is more or less higher than the former oxygen content. This is probably because the rate of raising temperature in F-2 is slow and consequently the carbon segregation becomes more uniform and that there is no high concentration of carbon, so that the rate of the deoxidation becomes slow.

Examples 14 to 16 concern the cases where the powder material G having a low oxygen content obtained by pulverizing the above described cake F, is reduced and G-1 ad G-2 follow to the method of the present invention and G-3 follows to the conventional process using hydrogen (D.P.: −50°C). In both G-1 and G-2, the reduction is effected at 1,350°C for 15 minutes. In G-1, a frequency of 1 KHz is used under hydrogen atmosphere (D.P.: −50°C) and the temperature is raised by the direct induction heating from room temperature to 1,350°C, while in G-2, a frequency of 380 KHz is used under vacuum of about $10^{-2}$ mmHg and for raising temperature, a preheating is once made in a resistance furnace to 600°C and then the induction heating is conducted. In G-3, the reduction is effected at 1,150°C for 10 hours. The oxygen contents in the obtained powders are 87 P.P.M. in G-1, 250 P.P.M. in G-2 and 526 P.P.M. in G-3, and G-1 where the rapid heating is effected by the induction heating is the lowest in the oxygen content. The oxygen content is G-3 is reversely increased by the final reduction, so that the treatment in G-3 is not reduction but is rather oxidation.

Thus, it is presumed from the oxygen contents of the powders obtained by the conventional final reduction in E-2 in Example 11, G-3 in Example 16, H-2 in Example 18, I-3 and I-4 in Examples 21 and 22 that about 500 P.P.M. is the lowest oxygen content which can be attained in such a low alloy steel powder in the conventional process. That is, the oxygen content of less than 500 P.P.M. can be scarcely accomplished unless the induction heating is applied.

Examples 17 and 18 are embodiments wherein the method of the present invention (H-1) and the conventional process (H-2) are applied to the powder material H obtained by reoxidizing the low alloy steel powders G having a low oxygen content with water. In H-1, the powders H are reduced at 1,350°C for 10 minutes under vacuum (about $10^{-2}$ mmHg) by means of a frequency of 450 KHz to effect deoxidation.

In H-2, the reduction is effected at 1,150°C for 10 hours under hydrogen (D.P.: −50°C).

In H-1, the temperature of 1,100°C is once kept and then said temperature is raised to 1,350°C. The oxygen contents after the reduction are 440 P.P.M. in H-1 and 1,500 P.P.M. in H-2 and the oxygen content in the present invention is lower than that in the conventional process of H-2.

Examples 19 to 22 show embodiments wherein the low alloy steel powder I obtained by water atomizing a molten low alloy steel added with 1% by weight of carbon is subjected to the final reduction.

In I-1, the reduction is conducted at 1,350°C for 15 minutes under vacuum of $10^{-2}$ mmmHg by means of a frequency of 450 KHz to effect deoxidation and in I-2, the reduction is conducted at 1,150°C for 15 minutes by using the same vacuum and frequency as in I-1 to effect deoxidation. Both I-1 and I-2 belong to the method of the present invention and the temperature of 1,100°C is once kept in the course of raising temperature and then said temperature is raised to the given temperature.

I-3 and I-4 belong to the conventional process and in I-3, the reduction is effected at 1,150°C for 10 hours under hydrogen atmosphere (D.P.: −50°C) and in I-4, the reduction is effected at 1,150°C for 7 hours under a high vacuum of $4.2\times10^{-5}$ mmHg. The oxygen contents of the reduced powders are 377 P.P.M. in I-1, 691 P.P.M. in I-2, 943 P.P.M. in I-3 and 812 P.P.M. in I-4.

The oxygen contents according to the present invention are lower than those in the conventional process.

Examples 23 and 24 show embodiments of deoxidation of the water atomized low alloy steel powders and the powder material J is one obtained by water atomizing the molten alloy steel having a carbon content of 0.21% and then mixing 3% by weight of rape seed oil to the resulting powders.

In J-1, the reduction is effected at 1,350°C for 15 minutes under vacuum of about $10^{-2}$ mmHg by means of a frequency of 450 KHz.

In J-2, the conventional hydrogen reduction is effected at 1,150°C for 10 hours.

In J-1, in the course of raising temperature, a temperature of 1,100°C is kept for a short time and then the temperature is raised to 1,350°C.

The oxygen contents of the reduced powders are 533 P.P.M. in J-1 and 1,000 P.P.M. in J-2.

J-1 shows that in the method of the present invention, a liquid, such as oil can be used as the reducing agent. Accordingly, the usable reducing agents in the present invention include solids, gases and liquids and are very broad.

Examples 25 to 27 are embodiments of deoxidation of a high alloy steel powder and the water atomized powder K corresponding to a high speed steel of SKH-9 is subjected to the final reduction by the method of the present invention (K-1) and the conventional process (K-2 and K-3).

In K-1, the reduction is effected at 1,250°C for 27 minutes under vacuum of about $10^{-2}$ mmHg but in the course of raising temperature, a temperature of 1,000°C is kept for 6 minutes.

In K-2, the reduction is effected at 1,150°C for 20 hours under hydrogen (D.P.: −50°C) and in K-3, the reduction is effected at 1,150°C for 7 hours under high vacuumm of $7.6\times10^{-5}$ mmHg.

The oxygen contents in K-1, K-2 and K-3 are 324 P.P.M., 1,100 P.P.M. and 667 P.P.M., respectively.

From these examples, it can be seen that also in the case of the high alloy steel powder, the method of the present invention is advantageous.

Examples 28 and 29 are embodiments wherein a low alloy steel powder having a high Si content in comparison with powders A-K is subjected to the final reduction according to the method of the present invention and the conventional process.

As seen from the data in Table 3, in the conventional process, it is impossible to lower the oxygen content to less than 1,000 P.P.M., while in L-1 of the present invention, the oxygen content is 618 P.P.M.

This has a very important significance and the low alloy steel powder alloyed with Si, which is inexpensive and has a low oxygen content, can be produced only by the method of the present invention. This makes the present invention more advantageous and effective.

It will be understood from these examples that the method of the present invention is very important and effective as the method for deoxidizing the iron or iron alloy powder materials and such an effectiveness is due to the deoxidation through the direct induction heating of the iron or iron alloy powder materials.

Namely, in the induction heating, a higher temperature can be attained in a short time and this temperature may be as high as possible within a range in which the fusing does not occur, if necessary and further the refractory is not directly heated, so that this method is very advantageous in view of the durability of the furnace.

As mentioned above, the present invention was explained in detail by the above examples, but as seen from the comparison of Example 12 with Example 13, Example 14 with Example 15 and Example 14 with Example 17, it has been found that the object to be inductively heated varies depending upon the amount of oxygen contained in the iron or iron alloy powders, regardless of the powdery state and the sintered body and that if the oxygen amount is small, the metal portion is essentially inductively heated, while when the oxygen amount is high, the non-metal portion, such as iron oxide and iron hydroxide, is inductively heated.

In order to confirm this fact, the powder material H having a high oxygen content obtained by spraying the powder material G, with water is attemted to the induction heating by means of a relatively low frequency of 1 KHz or 3 KHz but it is impossible to raise temperature without preheating. On the other hand, as shown in the above described Example 17, a relatively high frequency of 450 KHz can raise temperature very easily. Reversely, the powder material G having a low oxygen content can be inductively heated by a relatively low frequency of 1 KHz or 3 KHz as shown in Examples 14 and 12, while the induction heating cannot be effected by a high frequency, such as 380 KHz or 450 KHz as in Examples 15 and 17.

Furthermore, at a high temperature after raised temperature, the specific resistance of the non-metal portion becomes lower, while the specific resistance of the metal portion becomes higher, so that the difference of the specific resistance between the non-metal portion and the metal portion becomes small and hence it may be considered that the main body to be heated is both the portions. That is, when the starting material is preheated and then subjected to the induction heating, the frequency range to be used in the induction heating can be broadened, so that the desired frequency within the defined range can be selected.

Then, another novel discovery in the present invention is that when the method of the present invention is carried out under vacuum or a neutral atmosphere, the deoxidation advances apparently mainly in the form of $CO_2$ regardless of the reduction temperature as shown in Table 4 (the ratio of the decreased amount of carbon and oxygen before and after the reduction corresponds to 1 carbon atom : 2 oxygen atoms).

On the contrary, in the conventional vacuum annealing process, the deoxidation apparently mainly advances in the form of CO (the ratio of the decreased amount of carbon and oxygen before and after the reduction corresponds to 1 carbon atom : 1 oxygen atom) and this is greatly different from the method of the present invention. This difference is presumably due to the fact that the raising temperature in the method of the present invention is a rapid heating due to the direct induction heating of the iron or iron alloy powder materials to be deoxidized, while the raising temperature in the conventional process is a indirect heating and further a low rate of heating over a long time.

This means that, in the method of the present invention, the deoxidation proceeds in a non-equilibrium condition, while in the conventional process, the deoxidation proceeds substantially in an equilibrium state. When this is considered from the other view, the present invention has such an advantage that in order to obtain finally the powders having the same oxygen content, an amount of carbon to be added is sufficient to be less than the conventional process.

In Examples 12, 13 and 15 in Table 4, the oxygen contents in the powder materials are low and in this case, the deoxidation in the present invention is probably carried out mainly in the form of CO. As seen in Examples 1 and 10, when the oxygen content in the powder materials is about 0.3% by weight, the deoxidation is probably carried out in the forms of $CO_2$ and CO in half respectively.

Example 23 in Table 4 is an embodiment wherein the method of the present invention is applied to the powder material mixed with an oil and in this case, the form of CO is apparently higher.

It is not presently clear whether this CO rich waste gas is based on hydrogen and hydrocarbon gases evolved from the oil, but above is a rare case. In the present invention, the deoxidation mainly advances in the form of $CO_2$ and particularly when the method of the present invention is applied to the powder material having an oxygen content of not less than 0.6% by weight under vacuum or a neutral atmosphere, the ratio of the deoxidation in the form of $CO_2$ is more than 70% and the mechanism of the deoxidation in the present invention is considerably different from the conventional process.

The present invention can very broadly apply to pure iron powder, a low alloy steel powder, a high alloy steel powder and ferroalloy powder and the powders having a low oxygen content can be easily obtained.

Table 1

| Sample | Powder material | Production process of powder material | State of powder material | Relative density of powder material (%) | Addition of reducing agent |
|---|---|---|---|---|---|
| A | Pure iron powder | Reduction (preliminary reduction + final reduction) | Powdery | 32.3* | C content in iron powder: 0.003 wt.%, mixed with graphite powder |
| B | " | Reduction (preliminary reduction) | " | 17.8* | C content in sponge iron: 0.21 wt.%, mixed with graphite powder |
| C | " | Reduction (in course of preliminary reduction) | " | 28.8* | Mixed with graphite powder |
| D | " | Water atomizing | " | 36.5* | C content in iron powder: 0.26 wt.%, mixed with graphite powder |
| E | Low alloy steel powder | Water atomizing + hydrogen annealing | " | 40.3** | Carbon is alloyed in molten steel, C content in atomized powder: 1.06 wt.%, decarbonization, deoxidation |
| F | " | Water atomizing + present invention method | Sintered | 45.1** | Carbon is allowed in molten steel, C content in atomized powder: 1.06 wt.%, applying the present invention method |
| G | " | Water atomizing + present invention method | Powdery | 42.9** | Carbon is alloyed in molten steel, C content in atomized powder: 1.06 wt.%, applying the present invention method |

Table 1-continued

| | | | | | |
|---|---|---|---|---|---|
| H | " | Water atomizing + present invention method + water spraying oxidation | " | 39.2** | After iron powder G is oxidized, 1.22 wt.% of graphite powder is mixed thereto |
| I | " | Water atomizing | " | 40.7** | Carbon is alloyed in molten steel, C content in atomized powder: 1.06 wt.% |
| J | " | " | " | 38.1** | 0.21 wt.% of carbon is alloyed in molten steel, and said molten steel is water atomized and mixed with 3 wt.% of oil |
| K | High alloy steel powder | " | " | 34.7*** | Carbon is alloyed in molten steel, C content in atomized powder: 1.86 wt.% |
| L | Low alloy steel powder | " | " | 39.6** | Carbon is alloyed in molten steel, C content in atomized powder: 1.12 wt.% |

| Sample | Chemical composition (wt.%) | | | | | | | | | Remarks |
|---|---|---|---|---|---|---|---|---|---|---|
| | Total C | Si | Mn | Ni | Cr | Mo | W | V | O | |
| A | 0.29 | 0.025 | 0.24 | — | — | — | — | — | 0.32 | Final product (commercially available reduced iron powder) |
| B | 0.93 | 0.067 | 0.27 | — | — | — | — | — | 1.72 | Intermediate product (crushed sponge iron powder) |
| C | 3.52 | 0.021 | 0.35 | — | — | — | — | — | 7.54 | Intermediate product (crushed sponge iron powder containing about 30% of non-reduced portion) |
| D | 1.92 | 0.032 | 0.25 | — | — | — | — | — | 4.97 | Intermediate product (as water atomized powder) |
| E | 0.43 | 0.031 | 1.29 | 0.51 | 0.54 | 0.48 | — | — | 0.36 | Final product (hydrogen annealing: 1,000°C×4 hrs.) |
| F | 0.42 | 0.029 | 1.27 | 0.52 | 0.54 | 0.47 | — | — | 0.0377 | Intermediate product (powder I is treated with the induction heating at 1,350°C for 15 minutes under vacuum) |
| G | 0.42 | 0.029 | 1.27 | 0.52 | 0.54 | 0.47 | — | — | 0.0377 | Final product (pulverized cake of powder F) |
| H | 1.64 | 0.029 | 1.27 | 0.52 | 0.54 | 0.47 | — | — | 3.81 | Intermediate product (powder G is sprayed with water and dried in air |
| I | 1.06 | 0.031 | 1.28 | 0.51 | 0.55 | 0.49 | — | — | 1.49 | Intermediate product (as water atomized powder) |
| J | 1.47 | 0.028 | 1.33 | 0.49 | 0.52 | 0.56 | — | — | 1.58 | " |
| K | 1.86 | 0.043 | 0.26 | — | 4.16 | 4.90 | 6.08 | 1.74 | 1.16 | " |
| L | 1.12 | 0.34 | 1.36 | 0.48 | 0.51 | 0.49 | — | — | 1.62 | " |

Note: Density ratios (*,  and *) are ratios of the apparent density of said powder to the density of molding steel, 7.87 g/cm$^3$, 7.85 g/cm$^3$ and 8.16 g/cm$^3$, respectively.

Table 2-a

| Example and sample | Final reduction | Powder material | Atmosphere | Preheating | Time for raising temperature | Reduction temperture (°C) | Reduction time | Frequency (KHz) | Remarks |
|---|---|---|---|---|---|---|---|---|---|
| 1, A-1 | Present invention | A | Vacuum* (~10 ⁻²mmHg) | not | 7 min. | 1,300 | 15 min. | 8.3 | — |
| 2, A-2 | Conventional | A | Hydrogen (D.P. - 50°C) | " | 3 hrs. | 1,000 | 10 hrs. | — | — |
| 3, B-1 | Present invention | B | Vacuum* (~10 ⁻²mmHg) | not | 4 min. | 1,150 | 15 min. | 380 | — |
| 4, B-2 | Conventional | B | Hydrogen (D.P. - 50° C) | " | 3 hrs. | 1,000 | 5 hrs. | — | Graphite powder is not mixed, C content in powder material: 0.21 wt.% |
| 5, C-1 | Present invention | C | Vacuum* (~10 ⁻²mmHg) | not | 10 min. | 1,300 | 15 min. | 380 | Heated up to 1,000°C in 3 minutes, kept at 1,000°C for 6 minutes, then heated up to 1,300°C in 1 minute and kept at 1,300°C |
| 6, C-2 | Conventional | C | Hydrogen (D.P. - 50°C) | " | 3 hrs. | 1,000 | 10 hrs. | — | Mixed amount of graphite powder is the same as C-1 |
| 7, D-1 | Present invention | D | Vacuum* (~10 ⁻²mmHg) | not | 8.5 min. | 1,150 | 15 min. | 380 | Heated up to 1,000°C in 3 minutes, kept at 1,000°C for 3 minutes, then heated up to 1,150°C in 0.5 minute and kept at 1,150°C |
| 8, D-2 | " | D | Nitrogen | " | 12.5 min. | 1,150 | 15 min. | 380 | 7 minutes, kept at 1,000°C for 5 minutes, then heated up to 1,150°C in 0.5 minute and kept at 1,150°C |
| 9, D-3 | Conventional | D | Hydrogen (D.P. - 50 °C) | " | 3 hrs. | 1,000 | 10 hrs. | — | C content is the same as D-1 and D-2 |
| 10, E-1 | Present invention | E | Vacuum* (~10 ⁻²mmHg) | not | 5 min. | 1,350 | 15 min. | 8.3 | — |
| 11, E-2 | Conventional | E | Hydrogen (D.P. - 50°C) | " | 3 hrs. | 1,150 | 20 hrs. | — | — |
| 12, F-1 | Present invention | F | Vacuum* (~10⁻²mmHg) | not | 0.5 min. (room temp. → 1,350°C) | 1,350 | 20 min. | 3 | Room temperature → 1,350°C × 10 minutes → 600°C → 1,350°C × 10 minutes |
| 13, F-2 | " | F | Vacuum* (~10 ⁻²mmHg) | 600°C | 3 min. (600°C → 1,350°C) | 1,350 | 20 min. | 380 | Room temperature → preheated to 600°C → 1,350°C × 10 minutes → 600°C → 1,350°C × 10 minutes |
| 14, G-1 | Present invention | G | Hydrogen | not | 3 min. | 1,350 | 15 min. | 1 | — |
| 15, G-2 | " | G | Vacuum* (~10⁻²mmHg) | 600°C | 5 min. (600°C → 1,350°C) | 1,350 | 15 min. | 380 | When 380 KHz is used, if the preheating is lower than 600°C, the heating to raise temperature cannot be effected |
| 16, G-3 | Conventional | G | Hydrogen (D.P. - 50°C) | not | 3 hrs. | 1,150 | 10 hrs. | — | — |

*Only rotary pump is used.

Table 2-b

| Example and sample | Final reduction | Powder material | Atmosphere | Preheating | Time for raising temperature | Reduction temperture (°C) | Reduction time | Frequency (KHz) | Remarks |
|---|---|---|---|---|---|---|---|---|---|
| 17, H-1 | Present invention | H | Vacuum* (~10 ⁻²mmHg) | not | 7 min. | 1,350 | 10 min. | 450 | Heated up to 1,100°C in 2 minutes, kept at 1,100°C for 4 minutes, then heated up to 1,350°C in 1 minute and kept at 1,350°C |
| 18, H-2 | Conventional | H | Hydrogen (D.P. - 50°C) | " | 3 hrs. | 1,150 | 10 hrs. | — | — |
| 19, I-1 | Present invention | I | Vacuum* (~10 ⁻²mmHg) | not | 7 min. | 1,350 | 15 min. | 450 | Heated up to 1,100°C in 2 minutes, kept at 1,100°C for 4 minutes, then heated up to 1,350°C in 1 minute and kept at 1,350°C |
| 20, I-2 | " | I | Vacuum* | " | 5 min. | 1,150 | 15 min. | 450 | Heated up to 1,100°C in 2 minutes, kept at 1,100°C for 2.5 minutes, then heated |

Table 2-b-continued

| Example and sample | Final reduction | Powder material | Atmosphere | Preheating | Time for raising temperature | Reduction temperture (°C) | Reduction time | Frequency (KHz) | Remarks |
|---|---|---|---|---|---|---|---|---|---|
| | | | (~10 ²mmHg) | | | | | | up to 1,150°C in 0.5 minute and kept at 1,150°C |
| 21, I-3 | Conventional | I | Hydrogen (D.P. - 50 °C) | " | 3 hrs. | 1,150 | 10 hrs. | — | — |
| 22, I-4 | " | I | Vacuum** (4.2 × 10 ⁵ mmHg) | " | 3 hrs. | 1,150 | 7 hrs. | — | — |
| 23, J-1 | Present invention | J | Vacuum* (~10 ²mmHg) | not | 5 min. | 1,350 | 15 min. | 450 | Mixed with 3 wt.% of rape seed oil, heated up to 1,100°C in 1.5 minutes, kept at 1,100°C for 3 minutes, then heated up to 1,350°C in 0.5 minute and kept at 1,350°C |
| 24, J-2 | Conventional | J | Hydrogen (D.P. - 50°C) | " | 3 hrs. | 1,150 | 10 hrs. | — | Mixed with 3 wt.% of rape seed oil |
| 25, K-1 | Present invention | K | Vacuum* (~10 ²mmHg) | not | 14 min. | 1,250 | 27 min. 380 | for 6 minutes, then heated | Heated up to 1,000°C in 6 minutes, kept at 1,000°C up to 1,250° C in 2 minutes and kept at 1,250°C |
| 26, K-2 | Conventional | K | Hydrogen (D.P. - 50°C) | " | 3 hrs. | 1,150 | 20 hrs. | — | — |
| 27, K-3 | " | K | Vacuum** (7.6 × 10 ⁵ mmHg) | " | 3 hrs. | 1,150 | 7 hrs. | — | — |
| 28, L-1 | Present invention | L | Vacuum* (~10 ²mmHg) | not | 7 min. | 1,350 | 15 min. | 380 | Heated up to 1,000°C in 2.5 minutes, kept at 1,000°C for 4 minutes, then heated up to 1,350°C in 0.5 minute and kept at 1,350°C |
| 29, L-2 | Conventional | L | Hydrogen (D.P. - 50 °C) | " | 3 hrs. | 1,150 | 20 hrs. | — | — |

*Only rotary pump is used.
**Diffusion pump is used together with rotary pump.

Table 3

| Before final reduction | | | After final reduction | | | |
|---|---|---|---|---|---|---|
| Powder material | O content (%) | C content (%) | Example and sample | Final reduction process | O content (%) | C content (%) |
| A | 0.32 | 0.29 | Example 1, A-1 | Present invention | 0.0162 | 0.13 |
| | | | Example 2, A-2 | Conventional | 0.0735 | 0.21 |
| B | 1.72 | 0.93 | Example 3, B-1 | Present invention | 0.0149 | 0.21 |
| | | | Example 4, B-2 | Conventional | 0.0833 | 0.12* |
| C | 7.54 | 3.52 | Example 5, C-1 | Present invention | 0.0227 | 0.45 |
| | | | Example 6, C-2 | Conventional | 0.18 | 2.13 |
| D | 4.97 | 1.92 | Example 7, D-1 | Present invention | 0.0189 | 0.020 |
| | | | Example 8, D-2 | " | 0.0322 | 0.031 |
| | | | Example 9, D-3 | Conventional | 0.0892 | 1.28 |
| E | 0.36 | 0.43 | Example 10, E-1 | Present invention | 0.0214 | 0.25 |
| | | | Example 11, E-2 | Conventional | 0.0537 | 0.29 |
| F | 0.0377 | 0.42 | Example 12, F-1 | Present invention | 0.0098 | 0.39 |
| | | | Example 13, F-2 | " | 0.0139 | 0.40 |
| G | 0.0377 | 0.42 | Example 14, G-1 | Present invention | 0.0087 | 0.40 |
| | | | Example 15, G-2 | " | 0.0250 | 0.40 |

Table 3-continued

| Powder material | Before final reduction: O content (%) | Before final reduction: C content (%) | Example and sample | After final reduction: Final reduction process | After final reduction: O content (%) | After final reduction: C content (%) |
|---|---|---|---|---|---|---|
| | | | Example 16, G-3 | Conventional | 0.0526 | 0.37 |
| H | 3.81 | 1.64 | Example 17, H-1 | Present invention | 0.0440 | 0.13 |
| | | | Example 18, H-2 | Conventional | 0.15 | 0.95 |
| I | 1.49 | 1.06 | Example 19, I-1 | Present invention | 0.0377 | 0.43 |
| | | | Example 20, I-2 | " | 0.0691 | 0.49 |
| | | | Example 21, I-3 | Conventional | 0.0943 | 0.62 |
| | | | Example 22, I-4 | " | 0.0812 | 0.22 |
| J | 1.58 | 1.47 | Example 23, J-1 | Present invention | 0.0533 | 0.47 |
| | | | Example 24, J-2 | Conventional | 0.10 | 0.91 |
| K | 1.16 | 1.86 | Example 25, K-1 | Present invention | 0.0324 | 1.39 |
| | | | Example 26, K-2 | Conventional | 0.11 | 1.09 |
| | | | Example 27, K-3 | " | 0.0667 | 1.17 |
| L | 1.62 | 1.12 | Example 28, L-1 | Present invention | 0.0618 | 0.47 |
| | | | Example 29, L-2 | Conventional | 0.29 | 0.85 |

*Powder material is not mixed with graphite powder.

Table 4

| | Example and sample | (a)* Decreased amount of O (wt.%) | (b)** Decreased amount of C (wt.%) | (c)*** Assumed decreased amount of O in $CO_2$ form (wt.%) | (d)**** Assumed decreased amount of O in CO form (wt.%) | Apparent deoxidation form: ***** Ratio of $CO_2$ form, $\frac{(a)-(d)}{(c)-(d)} \times 100$ (%) | Apparent deoxidation form: ****** Ratio of CO form, $\frac{(c)-(a)}{(c)-(d)} \times 100$ (%) | O content in the starting powder material (wt.%) | Reduction temperature (°C) |
|---|---|---|---|---|---|---|---|---|---|
| Present invention method | 1, A-1 | 0.304 | 0.16 | 0.427 | 0.213 | 42.7 | 57.3 | 0.32 | 1.300 |
| | 3, B-1 | 1.71 | 0.72 | 1.92 | 0.96 | 78.1 | 21.9 | 1.72 | 1,150 |
| | 5, C-1 | 7.52 | 3.07 | 8.19 | 4.09 | 83.9 | 16.1 | 7.54 | 1,300 |
| | 7, D-1 | 4.95 | 1.90 | 5.07 | 2.53 | 95.7 | 4.3 | 4.97 | 1,150 |
| | 8, D-2 | 4.94 | 1.89 | 5.04 | 2.52 | 96.0 | 4.0 | 4.97 | 1,150 |
| | 10, E-1 | 0.339 | 0.18 | 0.453 | 0.227 | 49.3 | 50.7 | 0.36 | 1,350 |
| | 12, F-1 | 0.0279 | 0.03 | 0.080 | 0.040 | — | — | 0.0377 | 1,350 |
| | 13, F-2 | 0.0238 | 0.02 | 0.053 | 0.0267 | — | — | 0.0377 | 1,350 |
| | 15, G-2 | 0.0127 | 0.02 | 0.053 | 0.0267 | — | — | 0.0377 | 1,350 |
| | 17, H-1 | 3.77 | 1.51 | 4.03 | 2.01 | 87.6 | 12.4 | 3.81 | 1,350 |
| | 19, I-1 | 1.45 | 0.63 | 1.68 | 0.84 | 72.6 | 27.4 | 1.49 | 1,350 |
| | 20, I-2 | 1.42 | 0.57 | 1.52 | 0.76 | 86.8 | 13.2 | 1.49 | 1,150 |
| | 23, J-1 | 1.53 | 1.00 | 2.67 | 1.33 | 15.0 | 85.0 | 1.58 | 1,350 |
| | 25, K-1 | 1.13 | 0.47 | 1.25 | 0.63 | 79.4 | 20.6 | 1.16 | 1,250 |
| | 28, L-1 | 1.56 | 0.65 | 1.73 | 0.87 | 79.3 | 20.7 | 1.62 | 1,350 |
| Conventional method | 22, I-4 | 1.41 | 0.84 | 2.24 | 1.12 | 25.9 | 74.1 | 1.49 | 1,150 |
| | 27, K-3 | 1.09 | 0.69 | 1.84 | 0.92 | 18.5 | 81.4 | 1.16 | 1,150 |

* O content (wt.%) in the powder material before the final reduction — O content (wt.%) in the powder after the final reduction.

** C content (wt.%) in the powder material before the final reduction — C content (wt.%) in the powder after the final reduction.

*** Decreased amount of O based on the decreased amount of C described in column (b) of the above Table 4 by assuming that the deoxidation is effected in the form of $CO_2$.

**** Decreased amount of O based on the decreased amount of C described in column (b) of the above Table 4 by assuming that the deoxidation is effected in the form of CO.

***** The ratio (percentage) of deoxidation in apparent $CO_2$ form in the decreased amount of O described in column (a) of the above Table 4.

****** The ratio (percentage) of deoxidation in apparent CO form in the decreased amount of O described in column (a) of the above Table 4.

What is claimed is:

1. A method for producing iron or iron alloy powders having a low oxygen content to be used for powder metallurgy comprises subjecting iron or iron alloy powder materials having an oxygen content of not more than 8% by weight and a total carbon amount including carbon alloyed in said powders being not more than 6% by weight to an induction heating under a relative density of 5–65% based on a density of the molding steel of said powders by means of an alternating current of 50 cycles-1 megacycle to heat said powders at a temperature of 750°–1,400°C to effect reduction rapidly.

2. The method as claimed in claim 1, wherein the iron or iron alloy powders having an oxygen content of 0.6–8.0% by weight are subjected to the induction heating by means of the alternating current of 150 cycles-1 megacycle.

3. The method as claimed in claim 2, wherein said frequency is 10 kilocycles to 1 megacycle.

4. The method as claimed in claim 1, wherein the iron or iron alloy powders having an oxygen content of less than 0.6% by weight are subjected to the induction heating by means of the alternating current of 50 cycles-500 kilocycles.

5. The method as claimed in claim 4, wherein said frequency is 50 cycles-10 kilocycles.

6. The method as claimed in claim 1, wherein said reduction is effected under vacuum or a neutral atmosphere under such a condition that the iron or iron alloy powders contain carbon as a reducing agent.

7. The method as claimed in claim 6, wherein said carbon is selected from at least one member of the group consisting of graphite powders, and oil and an alloyed carbon.

8. The method as claimed in claim 1, wherein said reduction is effected under a reducing atmosphere.

9. The method as claimed in claim 1, wherein said powder material is added with water.

10. The method as claimed in claim 1, wherein said powder material is heated to 750°–400°C by the induction heating, said temperature is kept and then cooled to such a temperature that is lower than $Ar_1$ transformation temperature and forms pearlite transformation and carbon segregation, and then the temperature is raised to 750°–1,400°C by the induction heating and said temperature is kept and then fallen down.

11. The method as claimed in claim 1, wherein said powder material is preheated before induction heating for deoxidation.

* * * * *